US008137124B2

(12) United States Patent
Shaojun

(10) Patent No.: US 8,137,124 B2
(45) Date of Patent: Mar. 20, 2012

(54) SELF-LOCKING CONNECTOR FOR A CABLE TERMINATION

(75) Inventor: Zheng Shaojun, Shanghai (CN)

(73) Assignee: G&W Electric Company, Blue Island, IL (US)

( * ) Notice: Subject to any disclaimer, the term of this patent is extended or adjusted under 35 U.S.C. 154(b) by 3 days.

(21) Appl. No.: 12/679,979

(22) PCT Filed: Oct. 17, 2007

(86) PCT No.: PCT/US2007/081579

§ 371 (c)(1),
(2), (4) Date: Jun. 7, 2010

(87) PCT Pub. No.: WO2009/051590

PCT Pub. Date: Apr. 23, 2009

(65) Prior Publication Data

US 2010/0248525 A1 Sep. 30, 2010

(51) Int. Cl.
*H01R 13/627* (2006.01)

(52) U.S. Cl. ..... 439/352

(58) Field of Classification Search ..... 439/352, 439/350, 271, 278, 292, 372

See application file for complete search history.

(56) References Cited

U.S. PATENT DOCUMENTS 2,369,860 A * 2/1945 Schroeder ..... 439/289
2,520,739 A * 8/1950 Shaw ..... 439/268
4,222,593 A * 9/1980 Lauffenburger ..... 285/85
4,846,269 A 7/1989 Schnatzmeyer
5,911,445 A * 6/1999 Lee ..... 285/84
6,227,895 B1 5/2001 McFarlane
6,910,911 B2 * 6/2005 Mellott et al. ..... 439/358

OTHER PUBLICATIONS

ABB Switzerland Ltd. "GIS ELK-3 Gas-insulated Switchgear for Maximum Performance Up to 550 kV" (available at least as early as Jun. 2006).
G&W Electric Co. "G&W 115-161kV GIS Terminations" Catalog Supplement (Mar. 1994).
G&W Electric Co. "Transmission GIS Cable Terminations for Self-contained and Pipe Fluid Filled Cables" Catalog Supplement (Feb. 1996).
International Search Report and Written Opinion, International Patent Application No. PCT/US07/81579 (Apr. 30, 2008).
"Revision of IEEE 1300 Guide for Cable Connections to GIS" ICC Fall 2006 Meeting (Oct. 29 -Nov. 1, 2006).
United Electric "Medium Voltage Dry Style GIS Termination up to 42kV" (available at least as early as May 2007).

* cited by examiner

*Primary Examiner* — Tulsidas C Patel
*Assistant Examiner* — Phuongchi Nguyen
(74) *Attorney, Agent, or Firm* — Michael Best & Friedrich LLP

(57) ABSTRACT

A self-locking assembly for a cable termination having a connector with a step. The self-locking assembly includes a ring having a circumference and a plurality of latches located around the circumference. Each latch is configured to move between a locked position, where the latch is engaged with the step, and an unlocked position, where the latch is disengaged from the step. A sliding ring is configured to move along a portion of the connector and includes a groove, and a support ring is located on the connector and is configured to restrict movement of the sliding ring in at least one direction.

20 Claims, 5 Drawing Sheets

SELF-LOCKING CONNECTOR FOR A CABLE TERMINATION

BACKGROUND

The present invention relates to a connector design and method of connecting a high-voltage cable to electrical equipment (such as switchgear) in an electricity distribution substation. The term switchgear generally refers to the combination of electrical disconnects, fuses and/or circuit breakers used to isolate electrical equipment. One type of switchgear is "gas insulated switchgear" ("GIS"), where conductors and contacts are insulated by a gas, such as pressurized sulfur hexafluoride gas ("$SF_6$"). Cable terminations suitable to connect a high-voltage cable to a GIS device (often referred to simply as "a GIS") include fluid-filled cable, dry-type, and pipe-type.

SUMMARY

Although current connectors used to connect cables to switchgear are functional, a connector that is self-locking yet provides relatively easy disconnection of a cable termination from switchgear is desirable In one embodiment, the invention provides a self-locking assembly for a cable termination having a connector with a step. The self-locking assembly includes a ring having a circumference and a plurality of latches located around the circumference. Each latch is configured to move between a locked position, where the latch is engaged with the step, and an unlocked position, where the latch is disengaged from the step. The self-locking assembly also includes a sliding ring configured to move along a portion of the connector. The sliding ring has a groove. A support ring is located on the connector and configured to restrict movement of the sliding ring in at least one direction.

In another embodiment, the invention provides a self-locking assembly including a cable having a cable termination. The cable termination includes a connector with an outer surface, and a slide having a groove. The slide is configured to move along a portion of the outer surface of the connector. The cable termination also includes a stop connected to or integral with the connector and configured to restrict movement of the slide in at least one direction. A latch is configured to engage the outer surface of the cable termination in a locked state and engage the groove of the slide in a transition state.

In another embodiment, the invention provides a method of operating a self-locking assembly for a cable termination having a connector with an outer surface and a step. The self-locking assembly includes a latch, a biasing mechanism (such as a spring) biasing the latch towards the outer surface of the connector, a slide with a groove and configured to slide along a portion of the outer surface of the connector, and a stop coupled to the connector and configured to restrict movement of the slide in at least one direction. The method includes moving the cable termination in a first direction, moving the latch opposite to the bias of the biasing mechanism, disengaging the latch from the outer surface of the connector as a result of moving the latch, engaging the groove of the slide with the latch as a result of the biasing mechanism biasing the latch, moving the cable termination in a second direction opposite to the first direction, engaging the step with the slide, and disengaging the latch from the groove as a result moving the cable termination in the second direction and engaging the step with the slide.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
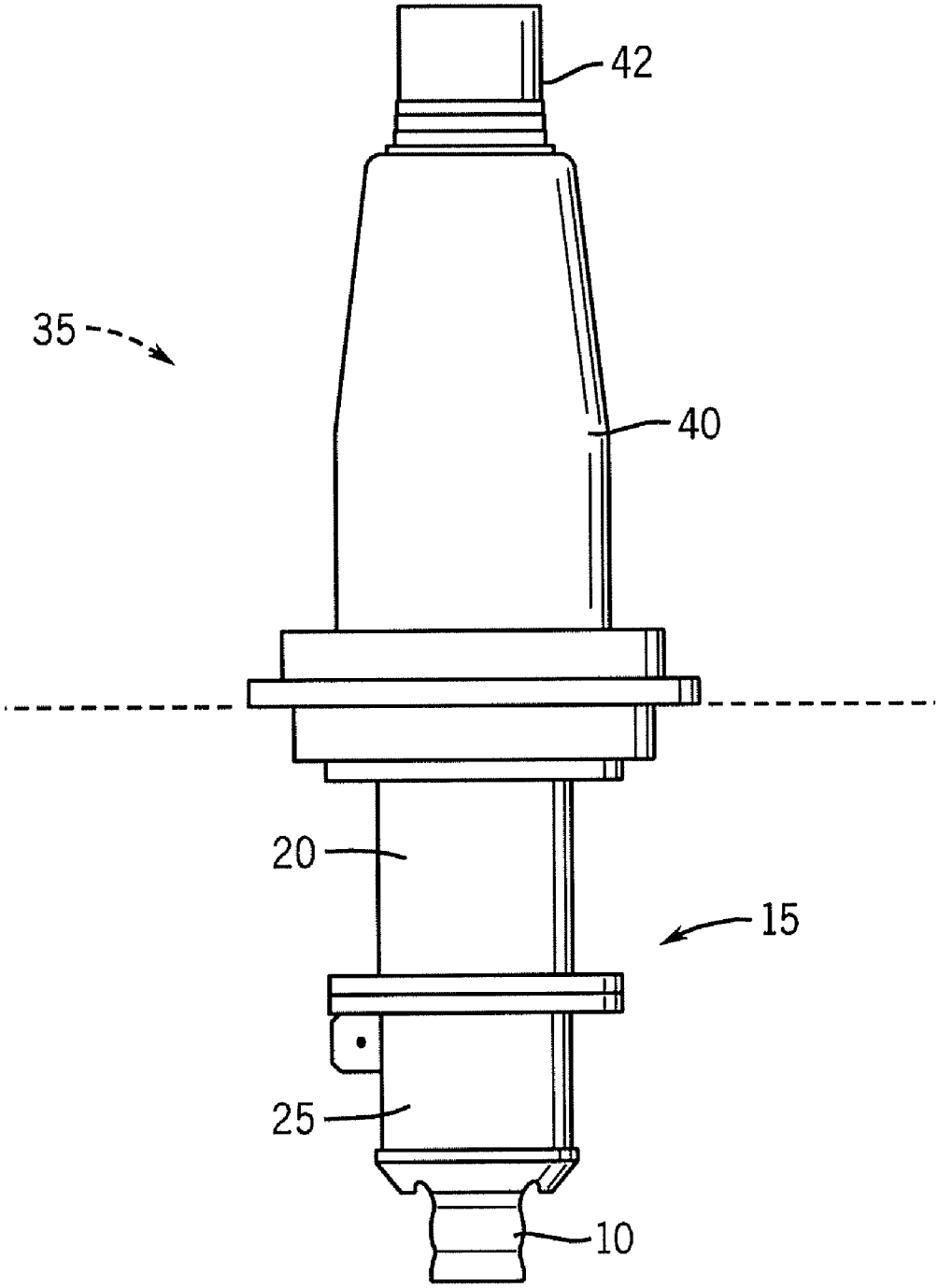
FIG. 1 is a perspective view of a cable termination coupled to a GIS.

FIG. 1 illustrates a portion of a cable 10. A cable termination 15 is attached to and surrounds part of the cable 10. The cable termination 15 includes a base plate 20 and an entrance housing 25. The cable termination 15 also includes a portion of a self-locking assembly 22. Part of the self-locking assembly 22 extends into a portion of a GIS 35. The self locking assembly 22 is illustrated in FIGS. 2-5 and will be described in greater detail below. The GIS 35 includes, among other things, a box insulator 40 that encloses components of the self-locking assembly 22. The GIS 35 also includes an insert 42. The cable termination 15 is detachably coupled or connected to the GIS 35. Although the illustrated construction describes and illustrates the cable termination 15 as being detachably connected to a GIS, it is to be understood that embodiments of the self-locking assembly could be used to connect cables to other types of switchgear or electrical equipment.

Figure 2:
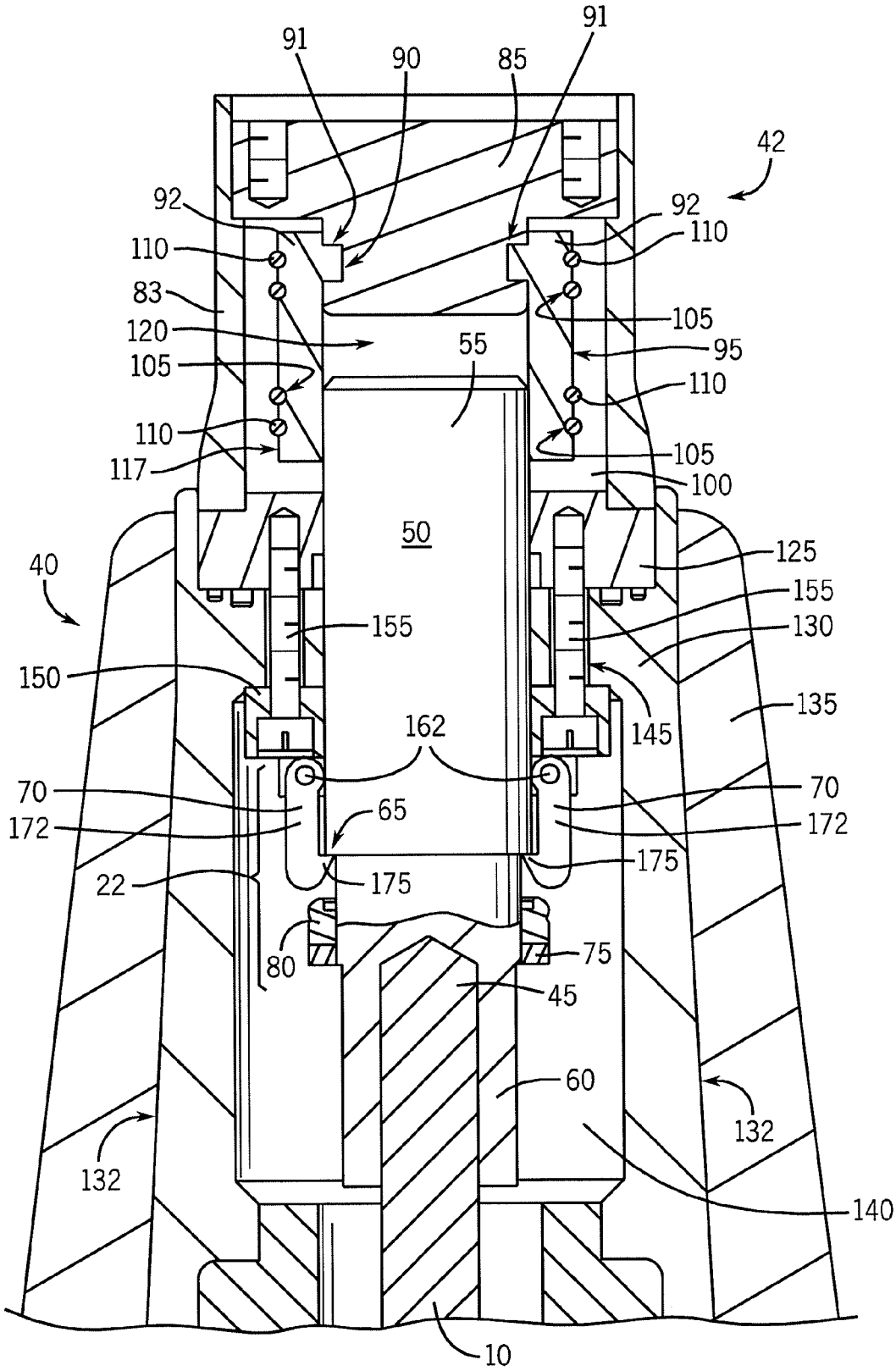
FIG. 2 is a cross-sectional view of the cable termination coupled to the GIS and illustrates a self-locking cable termination assembly.

FIG. 2 is a cross-sectional view of the cable 10, the GIS 35, and the self-locking assembly 22. In the illustrated construction, the cable 10 includes a first end 45. A cable connector 50 is connected to the first end 45. The cable connector 50 is part of the cable termination 15. In some cases, the cable 10 and the connector 50 are made from the same material. However, in other embodiments the cable 10 and connector 50 are manufactured of different materials. The connector 50 includes a head portion 55 and a support portion 60. The support portion 60 encloses, and is connected to the first end 45 of the cable 10. Each of the head portion 55 and the support portion 60 are substantially cylindrically shaped. The head portion 55 has a larger diameter than the support portion 60. The head portion 55 and the support portion 60 form a step 65. The step 65 is configured to receive one or more latches 70, as further explained below.

A stop 75 (which in the illustrated embodiment takes the form of a support ring) is fixedly connected to the support portion 60 of the connector 50. A slide 80 (which in the illustrated embodiment is a sliding ring) is movably or slidingly fit to the support portion 60 of the connector 50 between the support ring 75 and the step 65. The sliding ring 80 is configured to slide along the surface of the support portion 60 between the step 65 and the support ring 75. In the illustrated construction, the support ring 75 is below the sliding ring 80 such that the support ring 75 restricts motion or movement of the sliding ring 80 that might be caused by forces acting on the sliding ring 80 (e.g., gravity).

As illustrated in FIG. 2, the insert 42 of the GIS 35 includes an outer shell 83 defining a cavity 100 therein. Within the cavity 100, the outer shell 83 encloses a metal connector 85. The metal connector 85 includes an annular groove 90. The groove 90 of the connector 85 holds protrusions 91 from a number of connecting portions 92 forming a hollow cylinder 95. The annular groove 90 receives the protrusions 91 of the connecting portions 92 and, as a consequence, partially supports the cylinder 95. The connecting portions 92 of the cylinder 95 include four annular channels 105 that receive support springs 110. The two upper support springs 110 (with respect to FIG. 2) help support the connecting portions 92 against the groove 90 of the metal connector. Similarly, the two lower support springs 110 bias the connecting portions 92 towards the hear portion 55. Accordingly, a lower portion 117 of the connecting ring 95 receives and/or contacts the head portion 55 of the connector 50 such that a separation space or gap 120 is formed between the lower surface of the metal connector 85 and the upper surface of head portion 55.

Figure 3:
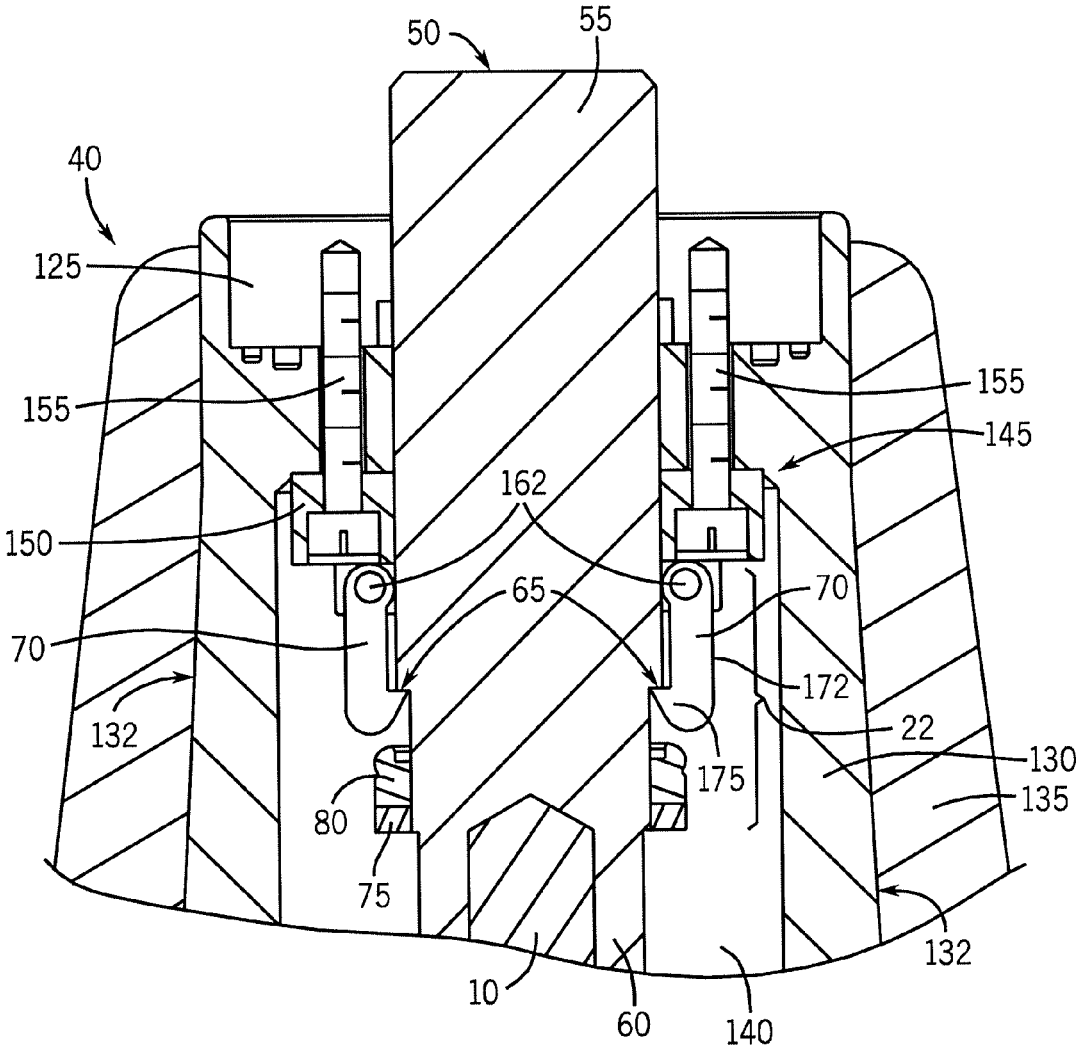
FIG. 3 is a detailed view of the cross-section in FIG. 2, illustrating the self-locking cable termination assembly in more detail.

As illustrated in FIGS. 2 and 3, the outer shell 83 of the insert 42 contacts an insulator 125 of the box insulator 40. The insulator 125 is supported by a metal insert 130. The metal insert 130 has an outer surface 132 enclosed by an epoxy cover 135. The metal insert 130 includes a cavity 140 that receives the connector 50, and supports a latch mounting structure or latch mount 145. The latch mount 145 holds the latches 70 (two latches are illustrated in FIGS. 2 and 3). The latch mount 145 also includes a threaded ring 150 with fasteners 155 (e.g., bolts, screws, etc.) extending therethrough and fastening the threaded ring 150 to the insulator 125.

Figure 5:
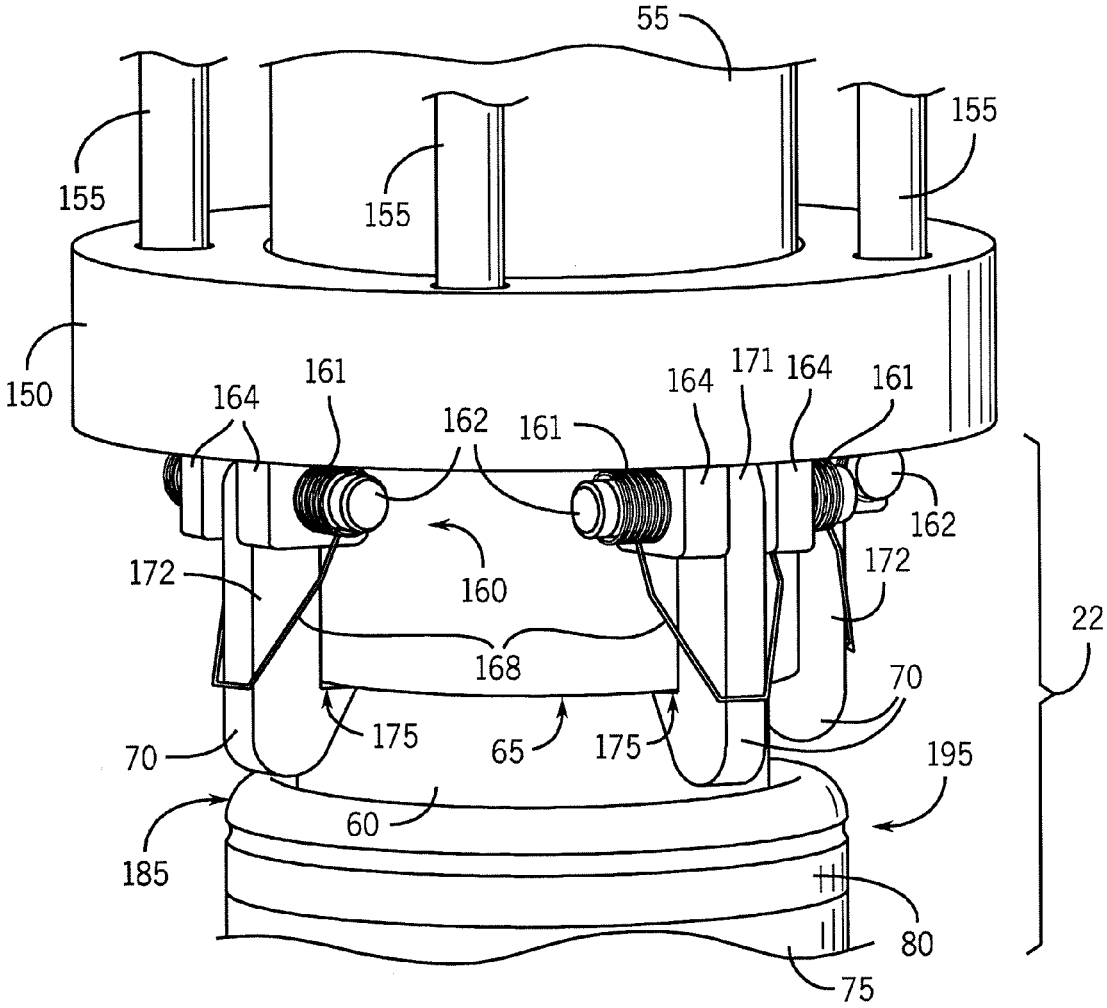
FIG. 5 is a perspective view of the self-locking cable termination assembly in a locked position.

As illustrated in FIG. 5, the threaded ring 150 supports each one of the latches 70 with a pin and spring assembly 160. Each pin and spring assembly includes a spring 161 and a through bolt or pin 162 that extends through a pair of supports 164. The latch 70 is positioned between the pair of supports 164 and the pin 162 extends through an aperture in the latch 70. The spring 161 biases the latch 70 to cause a hook 175 of each latch 70 to sit in the step 65. Each latch 70 also includes an upper portion 171 and a middle portion 172 connecting the upper portion 171 to the hook 175. In the illustrated construction, the upper portion 171 of the latch 70 snuggly fits between the supports 164 allowing only rotational movement of the latch 70 with respect to the pin 162. Other configurations, however, can include the latch 70 with more than one dimension of freedom or movement. The spring 161 is fixedly mounted on opposite ends of the pin 162 and includes a middle portion 168 that engages the latch 70.

The pin and spring assembly 160 and latches 70 are components of the self-locking assembly 22. As described in further detail below, the latches 70 can be moved from a locked state or position to an unlocked state or position. In the locked position (illustrated in FIGS. 2, 3, 4A and 5), the spring 161 causes the latches 70 to engage the step 65 and support the cable 10 via the connector 50. This holds the connector 50 in place and prevents it from disengaging from the GIS 35. As a consequence, a path is provided so that electric current can flow between the cable 10 and the GIS 35 via the connector 50, the connecting ring 95, and the metal connector 85. When the sliding ring 80 is moved appropriately, the latches 70 move from the locked position to an unlocked position (as illustrated in FIG. 4D, and further explained below). Other support or connection assemblies may be located along the cable 10 and GIS 35 to support or maintain a connection between the cable 10 and the GIS 35.

FIGS. 4A through 4D illustrate a portion of the self-locking assembly 22 and the latches 70 in the locked position (FIG. 4A), transition positions (illustrated in FIGS. 4B and 4C), and the unlocked position (FIG. 4D). As indicated above, the self-locking assembly 22 includes the spring 161, the latches 70 (only one latch 70 is illustrated in FIGS. 4A through 4D), the support ring 75, and the sliding ring 80. In the locked position, the hook 175 of the latch 70 engages the step 65 of the connector 50. The spring 161 (illustrated in FIG. 5) biases the latch 70 towards the connector 50 to secure the latch 70 against the connector 50. In the locked position, the sliding ring 80 generally rests on the support ring 75. However, friction between the sliding ring 80 and the connector 50 may be sufficient to maintain the sliding ring 80 in other positions between the support ring 75 and the latch 70 while the latch 70 is in the locked position.

Figure 4A:
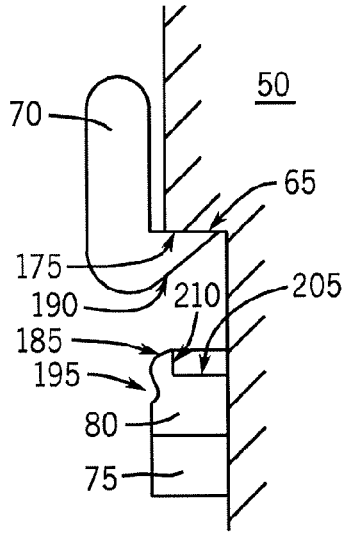
FIG. 4A is a partial view of the self-locking cable termination assembly in a first position.
Figure 4B:
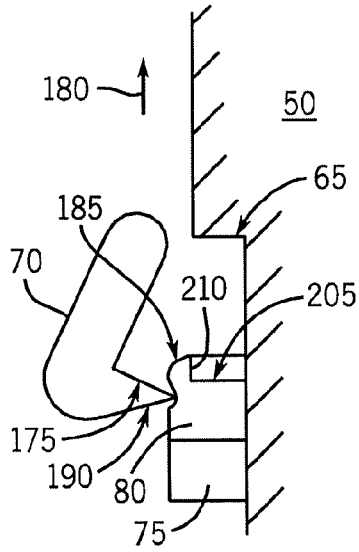
FIG. 4B is a partial view of the self-locking cable termination assembly in a second position.
Figure 4C:
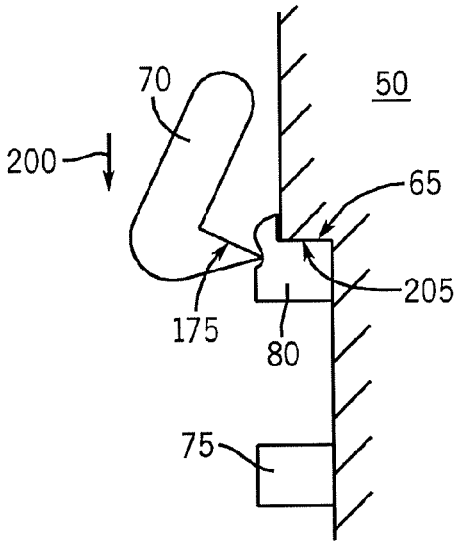
FIG. 4C is a partial view of the self-locking cable termination assembly in a third position.
Figure 4D:
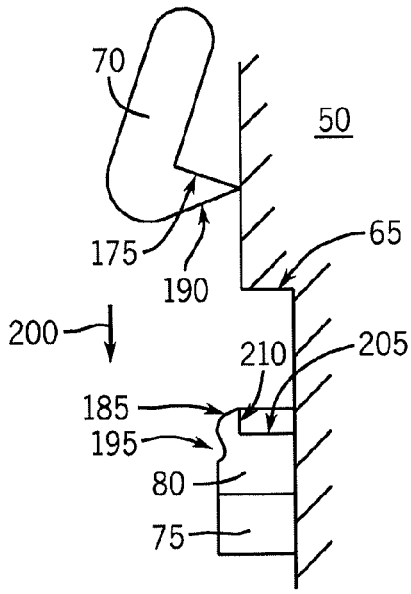
FIG. 4D is a partial view of the self-locking cable termination assembly in a fourth position.

FIGS. 4B and 4C illustrate two transition positions of the cable 10 and the self-locking assembly 22. To unlock the latches 70, the cable 10 is moved to disengage the cable 10 from the GIS 35. As illustrated in FIG. 4B, the cable is moved in an upward direction (with respect to FIGS. 4A through 4D) as indicated by arrow 180. The upward motion of the cable 10 causes a first contact surface 185 of the sliding ring 80 to engage a second contact surface 190 of the latch 70. As a result of the contact between the surfaces 185 and 190 and continued movement of the cable 10, the latch 70 is pushed outwardly against the bias of the spring mechanism 160. Subsequently, the hook 175 of the latch 70 engages a receiving groove or aperture 195 of the sliding ring 80. The gap 120 provides sufficient space to allow movement of the cable 10 and, in particular, the connector 50 toward the metal connector 85 such that the latches 70 can move to the unlocked position.

Subsequent to engaging the receiving groove 195 with the hook 175, the cable 10 is moved downwardly (with respect to FIGS. 4A through 4D) as indicted by arrow 200 in FIGS. 4C and 4D. As the cable is move downwardly, the latch 70 remains engaged to the sliding ring 80 such that the sliding ring 80 prevents the latch from contacting the surface of the connector 50, and, therefore, the step 65. In addition, the sliding ring 80 remains static with respect to the cable 10 such that the support ring 75 moves with respect to the latch 70 and the sliding ring 80. The sliding ring 80 also includes a shoulder or lip 205 formed radially inwardly with respect to the first contact surface 185. The lip 205 engages the step 65, as illustrated in FIG. 4C. In the illustrated construction, the lip 205 is substantially parallel with the surface defining the step 65. In addition, the first contact surface 185 is curved and angled with respect to the lip 205 and is separated from the lip 205 by a substantially vertical wall 210. In other constructions, the sliding ring 80 and the latch 70 can include other suitable structures promoting selective engagement and disengagement of the sliding ring 80 and the latch 70.

To complete movement of the latches 70 to the unlocked position, the cable 10 is moved downward further. The curved first contact surface 185 causes the latch 70 to slide as the cable 10 moves downwardly and the sliding ring 80 contacts the step 65. As a result, the latch 70 disengages the sliding ring 80 and the spring 161 biases the latch 70 towards the surface of the head portion 55 of the connector 50 without engaging the step 65 (as illustrated in FIG. 4D). Accordingly, the connector 50 and, consequently, the cable 10 are disengaged from the GIS 35.

To lock the cable 10 in the GIS 35 with the latches 70, the latches 70 are moved from the unlocked position to the locked position. The cable 10 is inserted into the GIS 35 so that the outer surface of the connector 50 contacts the latch 70 (as illustrated in FIG. 4D). The cable 10 is inserted so that the step 65 moves past the hook 175. The inner surface of the hook 175 then engages the step 65. In FIGS. 4A through 4D, the latch 70 is illustrated as rotating between the unlocked and locked positions. In other constructions, the latch 70 can be configured to move translationally and rotationally to engage and disengage the connector 50.

Various features and advantages of the invention are set forth in the following claims.

What is claimed is:

1. A self-locking assembly for a cable termination, comprising:

a connector connected to a cable of the cable termination, the connector having an outer surface and a step, the connector including a support ring fixed to the outer surface of the connector, and a sliding ring disposed between the support ring and the step, wherein the sliding ring is configured to move along a portion of the outer surface of the connector; and an insert for receiving the connector, the insert including at least one latch biased toward the outer surface of the connector, wherein the latch is configured to move between a locked position with the latch engaged with the step, and an unlocked position with the latch disengaged from the step;

wherein the support ring moves the sliding ring into contact with the latch in the locked position such that the sliding ring moves the latch into the unlocked position.

2. A self-locking assembly for a cable termination as claimed in claim 1, wherein the latch is configured to contact a portion of the outer surface of the connector when in the unlocked position.

3. A self-locking assembly for a cable termination as claimed in claim 1, wherein the sliding ring further includes a lip configured to engage the step and to facilitate disengaging the latch from the locked position.

4. A self-locking assembly for a cable termination as claimed in claim 1, wherein the insert further includes a mounting ring to which the latch is affixed.

5. A self-locking assembly for a cable termination as claimed in claim 1, wherein the latch is biased towards the outer surface of the connector via a spring.

6. A self-locking assembly for a cable termination as claimed in claim 1, wherein the latch includes a hook for engaging the step.

7. A self-locking assembly for a cable termination as claimed in claim 6, wherein the sliding ring includes a groove for engaging the hook to facilitate disengaging the latch from the locked position to the unlocked position.

8. A self-locking assembly for a cable termination as claimed in claim 7, wherein the sliding ring and the support ring are operable to move with respect to the latch in the locked position.

9. A self-locking assembly for a cable termination as claimed in claim 7, wherein the support ring is operable to move with respect to both the latch and the sliding ring in a transition state.

10. A self-locking assembly for a cable termination, comprising:

a connector connected to a cable of the cable termination and an insert for receiving the connector, the connector including a step formed between a larger-diameter terminal end and a smaller-diameter length connected thereto, wherein the connector comprises:

a support ring fixed to an outer surface of the smaller-diameter length; and a sliding ring disposed on the outer surface of the smaller-diameter length between the support ring and the step, wherein the sliding ring is configured to move along a portion of the outer surface of the smaller-diameter length and includes an engageable groove;

and wherein the insert comprises at least one latch biased toward an outer surface of the larger-diameter terminal end of the connector, the latch including a hook for engaging both the step and the groove of the sliding ring;

wherein the latch is configured to move between a locked position with the latch engaged with the step and an unlocked position with the latch disengaged from the step;

wherein the support ring moves the sliding ring into contact with the latch in the locked position forcing the latch into the unlocked position; and wherein the groove of the sliding ring engages the hook of the latch to facilitate disengaging the latch from the locked position to the unlocked position.

11. A method of operating a self-locking assembly for a cable termination, wherein the cable termination comprises a connector connected to a cable of the cable termination and received within an insert, wherein the insert includes a latch operable to lock the connector from moving in a first direction, the method comprising:

engaging the latch of the insert with a step of the connector to lock the connector from moving in a first direction;

moving a sliding ring of the connector in a second direction opposite to the first direction to disengage the latch from the step; and moving the connector in the first direction to place the assembly in an unlocked position.

12. A method of operating a self-locking assembly for a cable termination as claimed in claim 11, further comprising moving a support ring fixed to the connector in the second direction to force the sliding ring to disengage the latch from the step, wherein the sliding ring is disposed between the support ring and the step.

13. A method of operating a self-locking assembly for a cable termination as claimed in claim 11, further comprising engaging the step with a lip of the sliding ring to facilitate disengaging the latch.

14. A method of operating a self-locking assembly for a cable termination as claimed in claim 11, further comprising moving the sliding ring and the support ring with respect to the latch in the locked position.

15. A method of operating a self-locking assembly for a cable termination as claimed in claim 11, further comprising moving the support ring with respect to the latch and the sliding ring in a transition state.

16. A method of operating a self-locking assembly for a cable termination as claimed in claim 11, further comprising engaging a groove of the sliding ring with a hook of the latch to facilitate disengaging the latch from the step.

17. A method of operating a self-locking assembly for a cable termination as claimed in claim 16, further comprising disengaging the groove of the sliding ring with the hook of the latch when moving the connector in the first direction to place the assembly in the unlocked position.

18. A method of operating a self-locking assembly for a cable termination as claimed in claim 11, further comprising contacting a portion of an outer surface of the connector with the latch when in the unlocked position.

19. A method of operating a self-locking assembly for a cable termination as claimed in claim 18, further comprising biasing the latch towards the outer surface of the connector via a spring.

20. A method of operating a self-locking assembly for a cable termination as claimed in claim 18, further comprising placing at least a portion of the sliding ring between the outer surface of the connector and the latch to facilitate disengaging the latch from the step.

* * * * *